US007483020B2

(12) United States Patent
Tsuda et al.

(10) Patent No.: US 7,483,020 B2
(45) Date of Patent: Jan. 27, 2009

(54) DISPLAY DRIVE DEVICE, ELECTRO-OPTICAL DEVICE, ELECTRONIC APPARATUS, AND DRIVE SETUP METHOD OF THE DISPLAY DRIVE DEVICE

(75) Inventors: Atsunari Tsuda, Suwa (JP); Shingo Wakimoto, Matsumoto (JP)

(73) Assignee: Seiko Epson Corporation (JP)

( * ) Notice: Subject to any disclaimer, the term of this patent is extended or adjusted under 35 U.S.C. 154(b) by 696 days.

(21) Appl. No.: 10/807,912

(22) Filed: Mar. 24, 2004

(65) Prior Publication Data

US 2004/0239660 A1 Dec. 2, 2004

(30) Foreign Application Priority Data

Mar. 25, 2003 (JP) ..... 2003-083302
Mar. 25, 2003 (JP) ..... 2003-083383

(51) Int. Cl.
*G06F 3/038* (2006.01)

(52) U.S. Cl. ..... 345/204; 345/211

(58) Field of Classification Search ..... 345/211, 345/204, 87, 156; 711/103; 713/300
See application file for complete search history.

(56) References Cited

U.S. PATENT DOCUMENTS 5,828,367 A * 10/1998 Kuga ..... 345/211
6,072,465 A * 6/2000 Maeda et al. ..... 345/156
7,098,902 B2 * 8/2006 Tamura ..... 345/204
7,113,181 B2 * 9/2006 Tey et al. ..... 345/204
2002/0196243 A1 * 12/2002 Morita ..... 345/204
2003/0221046 A1 * 11/2003 Lin et al. ..... 711/103
2004/0160398 A1 * 8/2004 Yokota et al. ..... 345/87
2004/0201581 A1 * 10/2004 Miyazawa ..... 345/204
2005/0017965 A1 * 1/2005 Morita et al. ..... 345/211

FOREIGN PATENT DOCUMENTS

CN 1335975 2/2002

(Continued)

OTHER PUBLICATIONS

Examination result issued in corresponding Japanese application.

(Continued)

*Primary Examiner*—Amare Mengistu
*Assistant Examiner*—Yuk Chow
(74) *Attorney, Agent, or Firm*—Harness, Dickey & Pierce, P.L.C.

(57) ABSTRACT

A display drive device is provided that comprises a drive circuit for driving a display unit in which pixels are formed, a nonvolatile storage circuit for storing screen information indicating a position of a pixel to be driven in the display unit, a control circuit for reading the screen information from the nonvolatile storage circuit, and a drive setup circuit for setting a position based on the screen information read by the control circuit in the drive circuit. The display drive device may also comprise a nonvolatile storage circuit for storing setup information to change a drive voltage to be supplied to the drive circuit, a control circuit for reading the setup information from the nonvolatile storage circuit at predetermined intervals, and a voltage supply circuit for supplying a drive voltage based on the setup information read by the control circuit to the drive circuit.

12 Claims, 7 Drawing Sheets

FOREIGN PATENT DOCUMENTS

| | | |
|---|---|---|
| JP | 02-271389 | 11/1990 |
| JP | 04-166812 | 6/1992 |
| JP | 07-304495 | 10/1992 |
| JP | 05-341754 | 12/1993 |
| JP | 09-212142 | 8/1997 |
| JP | 10-301081 | 11/1998 |
| JP | 11-015444 | 1/1999 |
| JP | 11-296151 | 10/1999 |
| JP | 11-311980 | 11/1999 |
| JP | 2002-287703 | 10/2002 |
| JP | 2003-066938 | 3/2003 |
| JP | 2003-066939 | 3/2003 |
| JP | 2003-280615 | 10/2003 |
| JP | 2003-330433 | 11/2003 |
| JP | 2004-191581 | 7/2004 |
| JP | 2004-258879 | 9/2004 |
| WO | 01/33538 | 5/2001 |

OTHER PUBLICATIONS

Communications from Japanese Patent Office re: related applications.

Communication from Chinese Patent Office regarding counterpart application.

* cited by examiner

DISPLAY DRIVE DEVICE, ELECTRO-OPTICAL DEVICE, ELECTRONIC APPARATUS, AND DRIVE SETUP METHOD OF THE DISPLAY DRIVE DEVICE

RELATED APPLICATIONS

This application claims priority to Japanese Patent Application Nos. 2003-083302 filed Mar. 25, 2003 and 2003-083383 filed Mar. 25, 2003 which are hereby expressly incorporated by reference herein in their entireties.

BACKGROUND OF THE INVENTION

1. Field of Invention

The present invention is directed to a display drive device for driving an electro-optical device, for example, a liquid crystal display device, an electrophoresis device such as an electronic paper, an EL (Electro-Luminescence) display device, a field emission device (surface-conduction electron-emitter display), and the like. Further, the present invention is directed to an electronic apparatus comprising the above electro-optical devices.

2. Description of Related Art

Conventionally, setup information to change and set a drive voltage, such as an electronic volume value that is information for setting contrast, is transmitted from an external system comprising a microcomputer and the like in an LCD (Liquid Crystal Display) driver.

In this regard, in order to reduce a cumbersome setup of the setup information in assembling a display device comprising an LCD driver, an LCD driver has been proposed where the setup information is pre-stored in a nonvolatile storage unit and, based on the stored setup information, an electronic volume value is automatically set when the power is turned on.

Meanwhile, for example, a buyer who has obtained an LCD driver from a supplier sometimes takes notice that only a partial display region of a display unit is employed in a display drive. Hence, in assembling a display device using an LCD driver, the screen information, such as the resolution of a display unit, pixels to be driven, or an arrangement of sub-pixels (dots) constituting pixels, should be additionally set. This setup has conventionally been performed by reading a variety of commands from the conventional external system into an LCD driver.

Further, after setting an electronic volume value in that way, a register in which the information has been set may be suddenly cleared due to an external factor, such as an electrostatic discharge (ESD). Due to such a situation, an LCD driver cannot normally perform its display unless the electronic volume value is reset in the cleared register. The phenomenon where a setup is cleared by the above external factor similarly occurs due to a display grayscale characteristic value that adjusts an applied effective voltage for grayscale representation by pulse width modulation (PWM), a temperature compensation value that adjusts a change in a supply voltage accompanied with a change in environmental temperature, or a voltage generating circuit for transformation and supply of a power voltage, in addition to the setup information of the electronic volume value, in view of the fact that a register itself is suddenly cleared due to ESD and the like.

The present invention has been made in view of the above circumstances. Accordingly, an object of the present invention is to provide a display drive device, an electro-optical device, an electronic apparatus, and a drive setup method of the display drive device so as to automatically set screen information in a display unit. Further, it is another object of the present invention to provide a display drive device, an electro-optical device, an electronic apparatus, and a drive setup method of the display drive device so as to suppress abnormal display caused by clearing of the setup information.

SUMMARY

In order to solve the above objects, the present invention provides a display drive device comprising: a drive circuit for driving a display unit in which pixels are formed, a nonvolatile storage circuit for storing screen information indicating a position of a pixel to be driven in the display unit, a control circuit for reading the screen information from the nonvolatile storage circuit, and a drive setup circuit for setting a position based on the screen information read by the control circuit in the drive circuit. Thus, the screen information in a display unit can be automatically set, thereby solving the conventional complexity in adjusting a screen.

Further, preferably, in the above display drive device according to the present invention, the control circuit reads the screen information from the nonvolatile storage circuit in synchronization with the supply of a power voltage from a power circuit which supplies a voltage. In this way, the screen information in a display unit can be automatically set in synchronization with the supply of a power voltage, thereby solving the conventional complexity in adjusting a screen.

Further, preferably, in the above display drive device according to the present invention, the nonvolatile storage circuit stores the display information, the control circuit reads the display information from the nonvolatile storage circuit, and the drive circuit displays the display information read from the control circuit on the display unit. In this way, display information, such as lot numbers, may be displayed in synchronization with the setup of the screen information.

Further, the present invention provides a drive setup method of a display drive device comprising the steps of: reading screen information from a nonvolatile storage circuit which stores the screen information indicating a position of a pixel to be driven, in a display unit in which pixels are formed, setting a position based on the read screen information, and driving the position set in the display unit.

Moreover, in order to solve the above objects, the present invention provides a display drive device comprising: a drive circuit for driving a display unit in which pixels are formed, a nonvolatile storage circuit for storing setup information to change a drive voltage to be supplied to the drive circuit, a control circuit for reading the setup information from the nonvolatile storage circuit at predetermined intervals, and a voltage supply circuit for supplying a drive voltage based on the setup information read by the control circuit to the drive circuit. Thus, it is possible to renew setup information at any time and to suppress the period where the setup information as already set is suddenly cleared due to an external factor, such as ESD, to a minimum.

Further, preferably, in the above display drive device of the present invention, the control circuit receives instruction information for instructing the reading of the setup information and reads the corresponding setup information. Thus, it is possible to renew setup information at any time after the instruction information is transmitted.

Further, preferably, the above display drive device of the present invention further comprises a determination circuit that determines whether a drive voltage is supplied from the voltage supply circuit, and, if the determination is negative, re-starts the voltage supply circuit. Thus, it is possible to deal with abnormal display caused by an operation in a voltage generating means that are cleared due to an external factor, such as ESD, without a complicated setup operation.

Further, the present invention provides a drive setup method of the display drive device comprising the steps of: reading setup information from a nonvolatile storage circuit which stores the setup information to change and set a drive voltage for driving a display unit in which pixels are formed at predetermined intervals, and driving the display unit by a drive voltage based on the read setup information.

Further, the present invention can be employed in an electro-optical device comprising any display drive device as mentioned above.

Furthermore, the present invention can be employed in a variety of electronic apparatuses, such as projectors, liquid crystal televisions, portable telephones, electronic organizers, word processors, viewfinder type or monitor direct-viewing type video tape recorders, work stations, television telephones, POS terminals, touch panels, which comprise the above electro-optical device.

The operations and other advantages of the present invention will be apparent from the embodiments described later.

DETAILED DESCRIPTION OF PREFERRED EMBODIMENTS

Hereinafter, preferred embodiments of the present invention will be described with reference to the accompanying drawings. The electro-optical device of the present invention is applied to a liquid crystal device in the following embodiments.

First Embodiment

Figure 1:
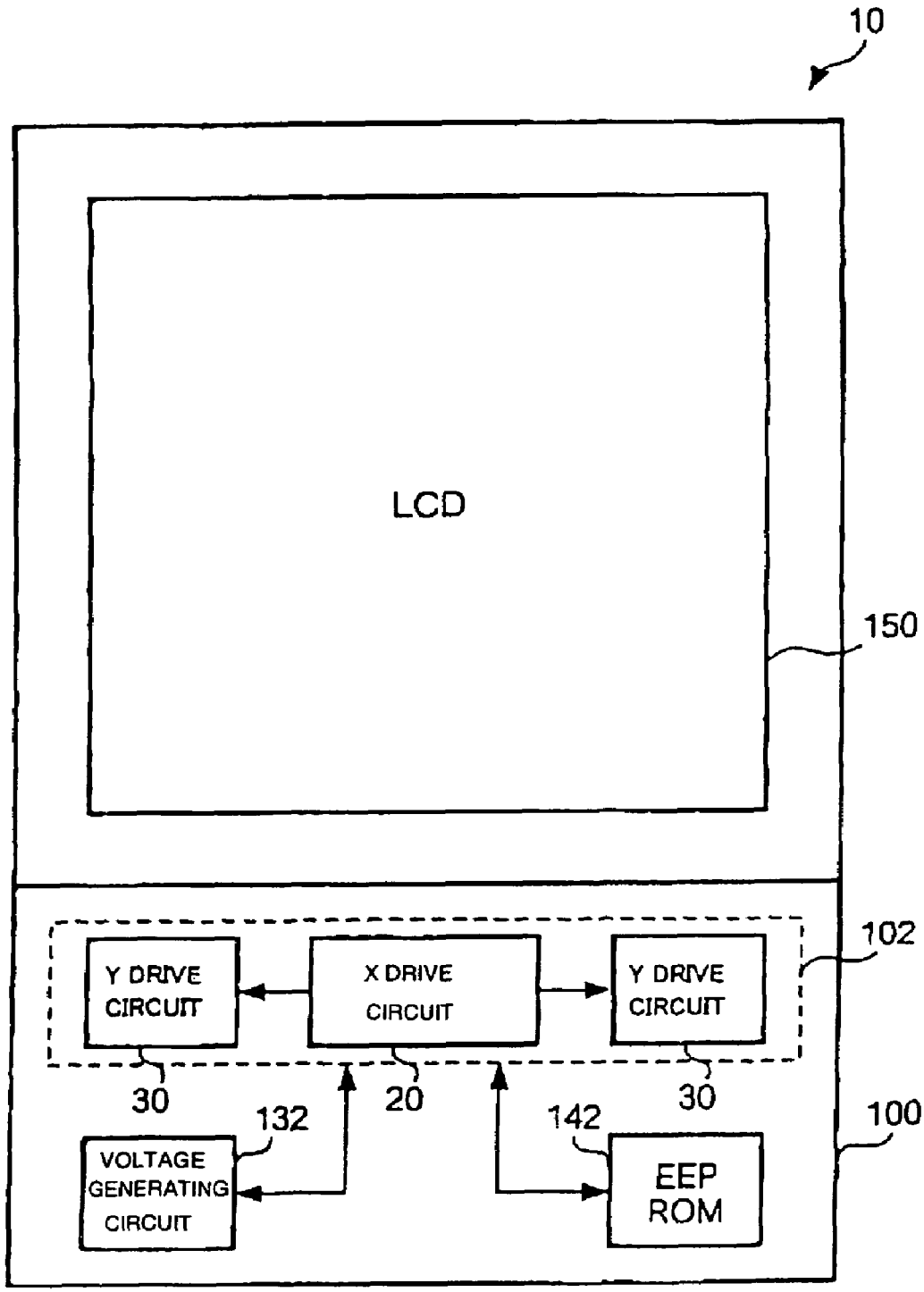
FIG. 1 illustrates a liquid crystal device comprising a display drive device of the present invention.

The construction of the display drive device in the first embodiment will be described with reference to FIGS. 1 and 2. FIG. 1 illustrates a block view of the liquid crystal device 10 comprising the display drive device 100 in the present embodiment. The display drive device 100 supplies an LCD 150 with a drive voltage based on the voltage supplied from a voltage generating circuit 132 that boosts a power voltage. A Y-drive circuit 30 is a circuit that supplies a selection voltage to scanning lines (not shown) of the LCD 150. An X-drive circuit 20 is a circuit that supplies a drive voltage to data lines (not shown) of the LCD 150.

Figure 3A:
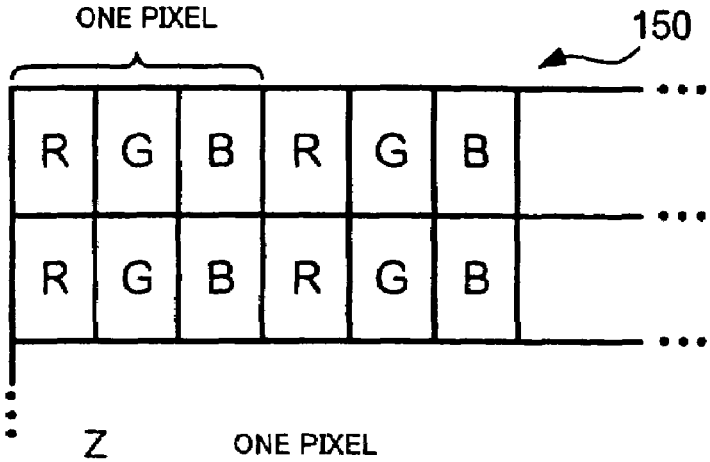
FIGS. 3A-B are views for explaining the arrangement of dots in the display drive device.
Figure 3B:
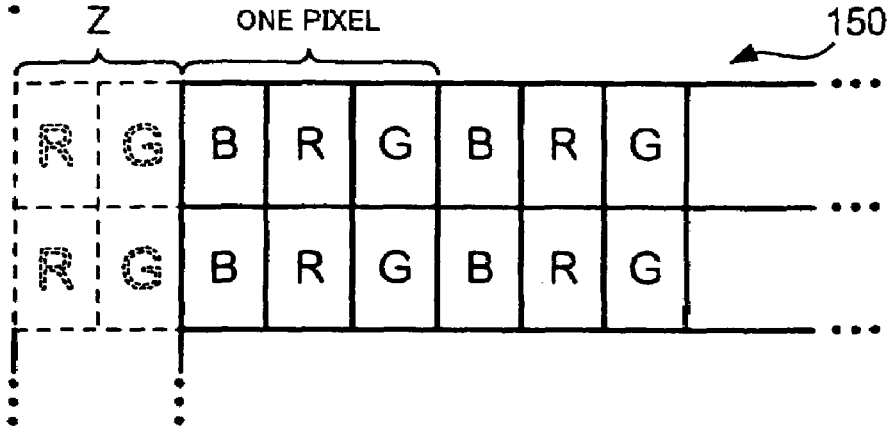

Nonvolatile storage means, EEPROM (Electrically-Erasable and Programmable Read-Only Memory) 142, stores screen information that has set pixel positions to be driven within the range of sub-pixels (-dots) formed in the LCD 150. For example, as shown in FIG. 3(*a*), in the LCD 150 where dots in units of RGBs are formed in order from the left, when the range z shown in FIG. 3(*b*) is not used (in this case, the dots are arranged in units of BRGs in order from the left), the screen information is set as information indicating the range excluding the range z.

Figure 2:
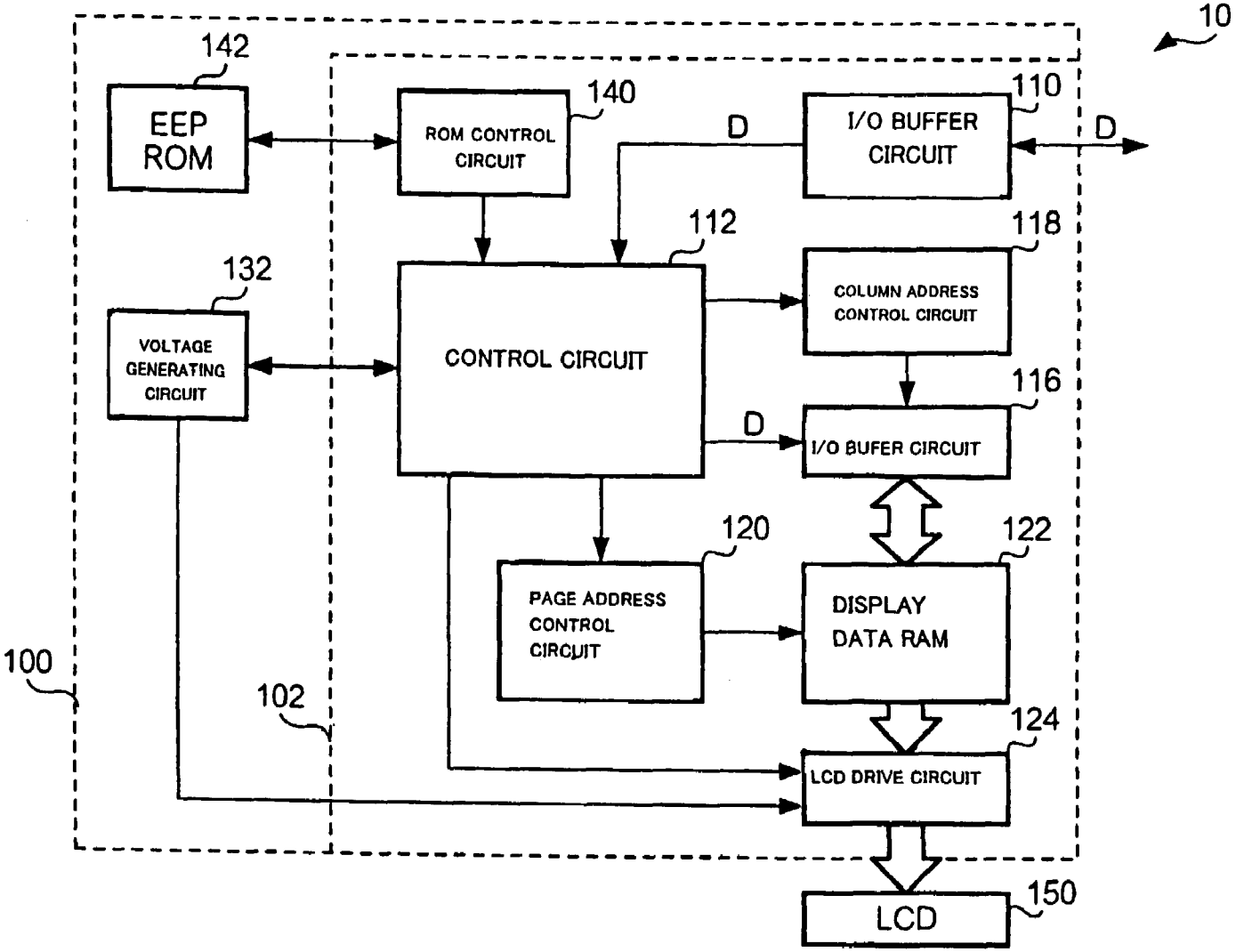
FIG. 2 is a block view illustrating the display drive device in the first and third embodiments.

FIG. 2 illustrates the construction of the display drive device 100. The display drive device 100 is equipped with a display data RAM (Random Access Memory) 122 that functions as a frame memory for display.

A control circuit 112 that receives a display data D indicating R (Red), G (Green), and B (Blue) transmitted from an I/O buffer circuit 110 transmits the display data D to an I/O buffer circuit 116.

A ROM control circuit 140 functioning as reading means reads the screen information stored in the EEPROM 142 or writes the screen information in the EEPROM 142. The ROM control circuit 140 employed as reading means gets access to the EEPROM 142 and reads the stored screen information in synchronization with the input of a reset signal from outside and the accomplishment of a system start of the display drive device 100. The ROM control circuit 140 gets access to the nonvolatile storage circuit, EEPROM 142, and transmits the read screen information to the control circuit 112 functioning as drive setup means at predetermined intervals, for instance, for every period two times longer than a frame frequency corresponding to the length of one vertical scanning period (1 V).

The control circuit 112 instructs the operation of reading or writing of a display data RAM 122 based on a display command supplied from a command decoder (not shown). Further, the control circuit 112 generates a control signal such as clock signal CLK, horizontal synchronization signal Hsync, vertical synchronization signal Vsync, grayscale control pulse (GCP) capable of performing pulse width modulation (PWM), as timing pulses. The control signals are supplied to a column address control circuit 118 and page address control circuit 120, whereby, along with the operation of reading or writing, setting or resetting of a counter to be stored in each of the circuits 118, 120 is performed. Thus, the display data D stored in the I/O buffer circuit 116 is sequentially written in the display data RAM 122.

The control circuit 112 functioning as drive setup means that receives screen information designates a writing address of the display data RAM 122 to the column address control circuit 118 and page address control circuit 120 based on a drive position shown in the screen information.

Figure 4:
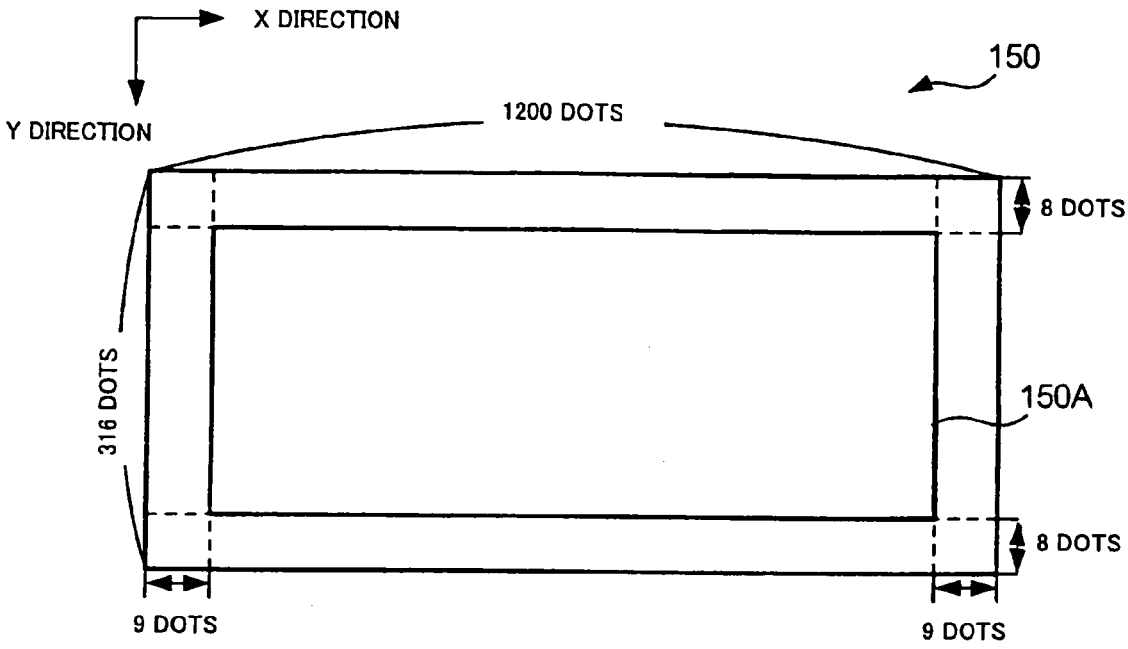
FIG. 4 is a view for explaining the range to be driven in the display drive device.

In this regard, as shown in FIG. 4, a case in which nine dots respectively provided at opposite ends in the X direction and eight dots respectively provided at opposite ends in the Y direction are not driven in the LCD 150 formed with three-hundred and sixteen (316) lengthwise dots and twelve-hundred (1200) widthwise dots will be explained as an example (i.e., what is driven is within the range of 150 A).

The control circuit 112 as drive setup means designates a writing address of the display data RAM 122 to the column address control circuit 118 and page address control circuit 120, and causes the display data RAM 122 to write information of the display data D in a memory device corresponding to the drive range 150 A as shown in FIG. 4. The written display data D is read as one line display data of 'RGB X 394 (pixel number in the X direction)=1182 dots' in the Y direction and is converted into a drive voltage to be supplied to the LCD 150 by an LCD drive circuit 124.

Moreover, in this connection, as shown in FIG. 3, when a dot arrangement is temporarily changed and is seen from the left end, one unit of a pixel is expressed by sub-pixels of BRG.

Thus, the control circuit 112 as drive setup means instructs a writing address of the RG display data of the RGB display data being transmitted from the display data RAM 122 and input buffer circuit 110, to the column address control circuit 118 and page address control circuit 120. As a result, display driving having BRG as one unit of a pixel is performed in the LCD 150.

Figure 5:
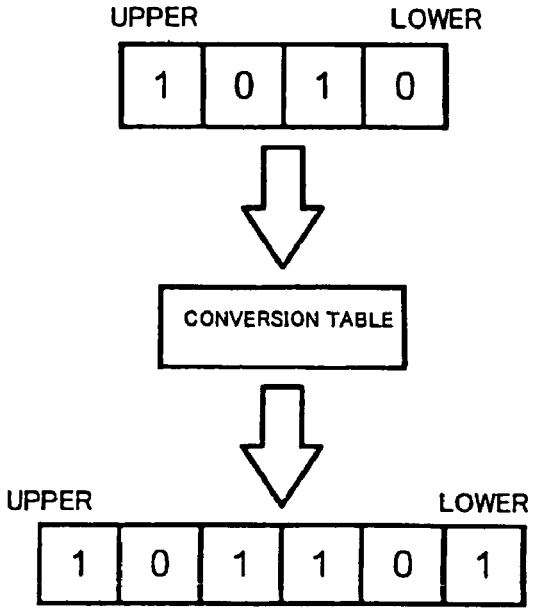
FIG. 5 is a view for explaining the conversion processing of resolution information in the display drive device.

Besides, as shown in FIG. 5, the ROM control circuit 140 reads the conversion information in data mode from the EEPROM 142 as described below. The control circuit 112 receives the display data D indicating R (Red), G (Green), and B (Blue) transmitted from the I/O buffer circuit 110 based on the conversion information, and converts, for example, data mode in a unit of 6 bits and data mode in a unit of 4 bits to each other based on a conversion table where the conversion information is defined. At this time, the display data '1010' in a unit of 4 bits is converted into the display data '101101' in a unit of 6 bits by the conversion table. After this conversion, a drive voltage corresponding to the display data '101101' is supplied to the LCD 150.

This makes it possible to display the display data from a low resolution to a high resolution.

In this way, in synchronization with the input of power, the screen information, such as a pixel to be driven in an LCD, a dot arrangement constituting the pixel, or a resolution, is automatically set, thereby removing complexity in adjusting a screen that has conventionally been properly carried out by an external system.

Second Embodiment

Next, the display drive device in the present second embodiment will be explained. As for the display drive device of the present embodiment, unique lot number information capable of specifying the present device is displayed and driven in the LCD 150 as display information in the display drive device 100 of FIG. 2. Lot number information is previously stored in the EEPROM 142 of the display drive device in the present embodiment. Hereinafter, a display drive device of the present embodiment will be explained referring to FIG. 2 for convenience.

Figure 6:
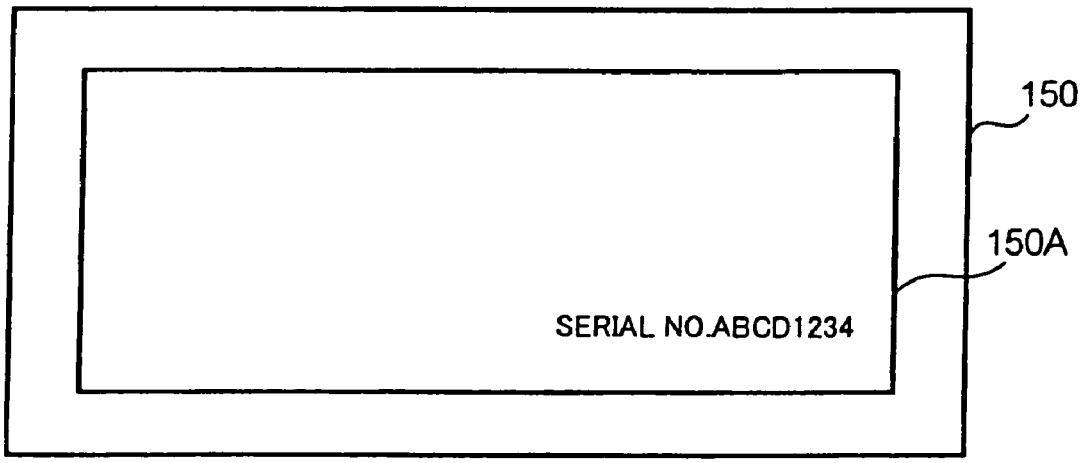
FIG. 6 illustrates the lot number information outputted by the display drive device in a second embodiment.

The ROM control circuit 140 functioning as reading means in the display drive device of the present embodiment gets access to the EEPROM 142 and reads the stored lot number information, in synchronization with the input of a reset signal from outside and the accomplishment of a system start of the display drive device 100. The ROM control circuit 140 transmits the read screen information to the control circuit 112. The control circuit 112 transmits the received lot number information to I/O buffer circuit 116. This allows the lot number information to be written in the display data RAM 122. Then, the lot number information is displayed and driven on the LCD 150 by the LCD drive circuit 124. FIG. 6 illustrates a case in which, for example, 'Serial No. ABCD1234' is displayed on the LCD 150 as lot number information.

Along with automatic setup of the screen information in an LCD in synchronization with the input of power, this enables command by the conventional external system or lot number information managed with seals to be confirmed simultaneously with the input of power.

In the display drive device in the second embodiment as described above, lot number information, is displayed on the LCD 150, which is an integrated circuit (IC), as display information. In addition, for example, in the case where a voltage generating circuit 132 is integrally formed as a separate IC, the lot number information of the voltage generating circuit 132 may be stored. Besides, this is similarly applied to the LCD 150, EEPROM 142 or LCD drive circuit 124 or the like.

Further, when the lot number information is displayed on the LCD 150, the lot number information may be directly transmitted to the LCD drive circuit 124 and displayed and outputted on the LCD 150 without passing through the display data RAM 122 other than being displayed and outputted on the LCD 150 through the display data RAM 122 as described above.

Third Embodiment

The construction of the display drive device in the third embodiment of the present invention will be explained referring to FIGS. 1 and 2. FIG. 1 illustrates a block view of the liquid crystal device 10 comprising the display drive device 100 in the present embodiment. The display drive device 100 supplies the LCD 150 with a drive voltage based on the booster voltage supplied from the voltage generating circuit 132 that boosts a power voltage. The Y-drive circuit 30 is a circuit that supplies a selection voltage to a scanning line (not shown) in the LCD 150. The X-drive circuit 20 is a circuit that supplies a drive voltage to a data line (not shown) in the LCD 150.

An EEPROM 142, which is nonvolatile storage means, stores an electronic volume value to execute a change in a drive voltage to be supplied to the LCD 150.

FIG. 2 illustrates the construction of the display drive device 100. The display drive device 100 is equipped with the display data RAM (Random Access Memory) 122 that functions as a frame memory for display.

The control circuit 112 that receives the display data D indicating R (Red), G (Green), and B (Blue) transmitted from the I/O buffer circuit 110 transmits the display data D to the I/O buffer circuit 116.

The control circuit 112 instructs the operation of reading or writing to the display data RAM 122 based on a display command supplied from a command decoder (not shown).

Further, the control circuit 112 generates control signals, such as a clock signal CLK, a horizontal synchronization signal Hsync, and a vertical synchronization signal Vsync, which are timing pulses, and a grayscale control signal GCP (Grayscale Control Pulse) capable of performing PWM (Pulse Time Modulation). The control signals are supplied to a column address control circuit 118 and a page address control circuit 120, whereby, along with the operation of reading or writing, setting or resetting of a counter to be stored in each of the circuits 118, 120 is performed. Thus, the display data D stored in the I/O buffer circuit 116 is sequentially written in the display data RAM 122.

A ROM control circuit 140 reads the electronic volume value stored in the EEPROM 142 or writes it in the EEPROM 142.

The ROM control circuit 140 functioning as reading means gets access to the EEPROM 142 and reads the stored electronic volume value, in synchronization with the input of a reset signal from outside and the accomplishment of a system start of the display drive device 100. The ROM control circuit 140 gets access to the EEPROM 142, and transmits the read electronic volume value to the voltage generating circuit 132 which is voltage supply means at predetermined intervals, for instance, for every period two times longer than a frame frequency corresponding to the length of one vertical scanning period (1 V).

The voltage generating circuit 132 functioning as voltage supply means receives the electronic volume value, and performs adjustment of a voltage level supplied to the LCD drive circuit 124.

A group of display data D corresponding to one screen of the LCD 150 stored in the display data RAM 122 is sequentially transmitted to the LCD drive circuit 124 according to the reading instruction frequently supplied from the control circuit 112.

The LCD drive circuit 124 latches a group of display data transmitted from the display data RAM 122 by one (1) line according to the timing of the horizontal synchronization signal Hsync on the basis of the clock signal CLK supplied from the control circuit 112. The LCD drive circuit 124 selects scanning lines inside the LCD 150 sequentially, and supplies each data line inside the LCD 150 with a drive voltage corresponding to the latched display data D according to the GCP signal generated in the control circuit 112.

The voltage generating circuit 132, if it is determined that the setup information indicating an electronic volume value has been received, transforms the voltage supplied to the LCD 150 according to the electronic volume value.

By the way, after an electronic volume value is set in the voltage generating circuit 132 with power input, the register where the information has been set may be suddenly cleared due to an external factor, such as ESD.

On the contrary, the display drive device 100 of the present invention reads the electronic volume value stored in the EEPROM 142, for example, for every period two times longer than a frame frequency corresponding to the length of one vertical scanning period (1 V), using the ROM control circuit 140, and transmits it to the voltage generating circuit 132. The voltage generating circuit 132 stores the received electronic volume value in a register therein and renews the setup.

Thus, in the display drive device 100, it is possible to frequently renew an electronic volume value, thereby suppressing the period where the register as already set is suddenly cleared due to an external factor, such as ESD, to a minimum.

Another Embodiment of the Display Drive Device 100

In the above described embodiments, an electronic volume value is stored in the EEPROM 142 as initial setup information and is frequently renewed in the voltage generating circuit 132. However, it is possible to frequently renew a temperature compensation value or a display grayscale value, etc., other than the initial setup information.

In the case where a temperature compensation value and display grayscale value to be renewed are previously stored in the EEPROM 142, the ROM control circuit 140 reads the temperature compensation value and display grayscale value stored in the EEPROM 142, for example, for every period two times longer than a frame frequency corresponding to the length of one vertical scanning period (1 V), and transmits it to the voltage generating circuit 132.

The voltage generating circuit 132 renews a storage value of the register where a variable resistance value is stored inside the transformation circuit (not shown) where a setup corresponding to the temperature compensation value is made. As a result, a power voltage to be supplied in conformity with environmental temperature is frequently renewed.

Further, the PWM decoder (not shown) of the voltage generating circuit 132 renews a pulse width W obtaining a desired effective voltage during one horizontal scanning period (1 H), in the grayscale control signal GCP where a setup corresponding to the display grayscale value is made. Thus, the pulse width W that controls a grayscale level is frequently renewed. Further, in case of performing a grayscale setup using a voltage control method, the voltage generating circuit 132 renews the setup voltage value.

Another Embodiment of the Display Drive Device 100

The present embodiment describes a display drive device according to another embodiment of the display drive device 100 as stated above. Further, for the purpose of convenience, the construction and operation of the display drive device will be described referring to FIG. 2.

In the display drive device of the present embodiment the ROM control circuit 140 receives the instruction command that indicates reading of the electronic volume value received through the I/O buffer circuit 110. The ROM control circuit 140 gets access to the EEPROM 142 based on the instruction command and transmits the read electronic volume value to the voltage generating circuit 132.

In this way, the display drive device of the present embodiment performs a frequent transmission instruction of the instruction command, which enables an instant renewal of initial setup information, such as electronic volume value. As a result, it is possible to suppress a period during which the register as already set is suddenly cleared due to an external factor, such as ESD, to a minimum.

Moreover, the transmission setup of an instruction command by a user's operation may be performed, thereby frequently renewing the initial setup information.

Fourth Embodiment

Figure 7:
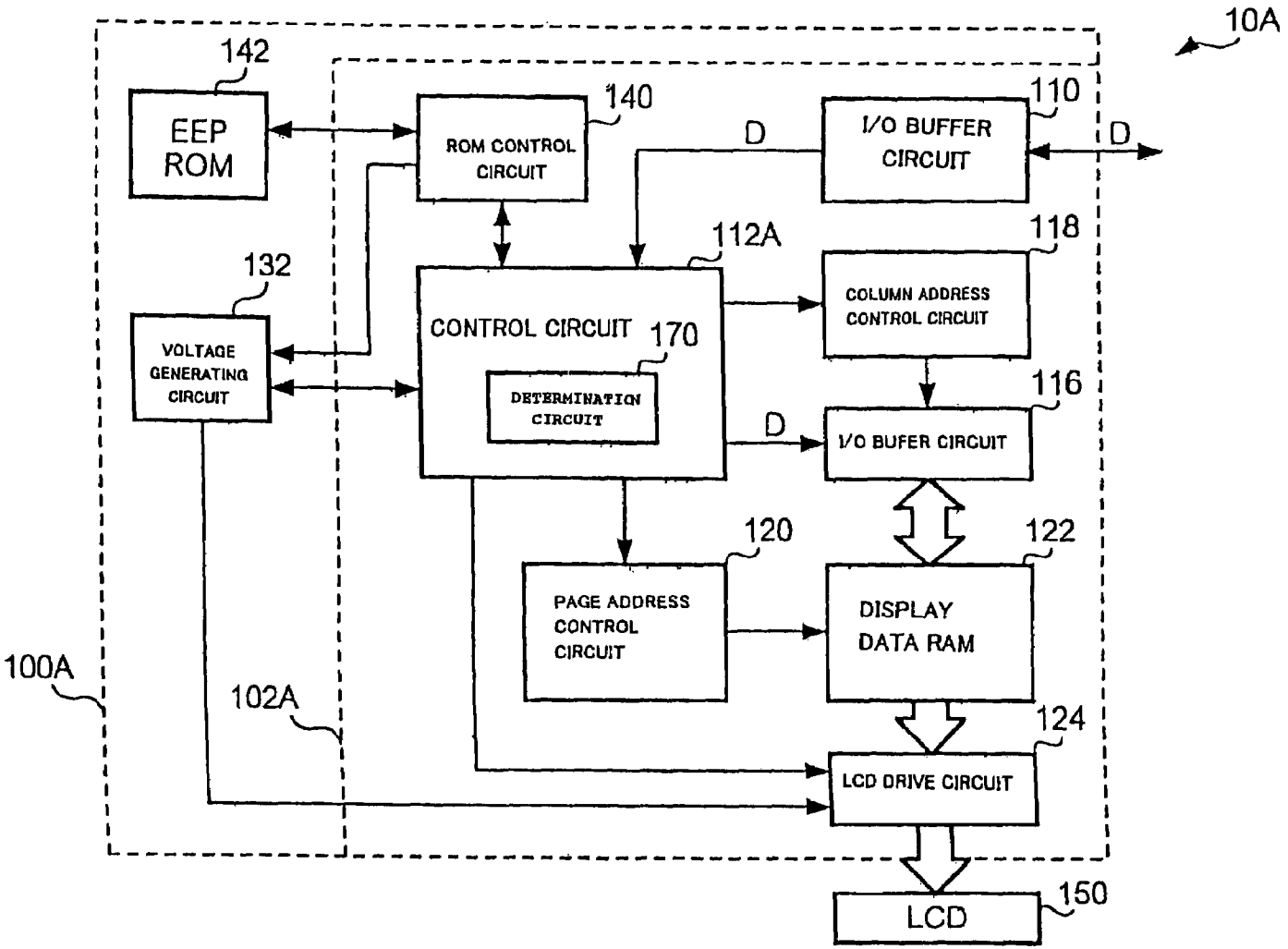
FIG. 7 is a block view of the display drive device according to a fourth embodiment of the present invention.

FIG. 7 illustrates a display drive device 100A of still another embodiment of the above display drive device 100 of FIGS. 1 and 2. Further, hereinafter, the reference numerals used in the display drive device 100 of FIGS. 1 and 2 and their explanation will be omitted in the description of FIG. 7. A processing unit with additional functions other than those of the processing unit shown in FIGS. 1 and 2 will be described, and is given reference numerals having the alphabetical designation 'A'.

In the display drive device 100A, the control circuit 112A is equipped with a determination circuit 170 that determines whether the operation state of the voltage generating circuit 132 exists or not based on this determination, the display drive device 100A does a re-setup operation if a non-operation state of the voltage generating circuit 132 is confirmed.

The voltage generating circuit 132 supplies the LCD drive circuit 124 with a standard voltage that boosts a power voltage when normally supplying voltage (i.e., the storage value of an operation register that sets up the operation becomes 1 (ON)). To the contrary, in the case where the storage value of a register that performs the operation setup becomes 0 (OFF), the voltage generating circuit 132 goes to a non-operation state.

The determination circuit 170 in the control circuit 112A of the display drive device 100A should frequently read voltage supplied from the voltage generating circuit 132, and determines whether the operation of a voltage supply is normally performed or not.

When a non-supply state of voltage from the voltage generating circuit 132 has been determined, the determination circuit 170 makes the voltage generating circuit 132 into the operation state, which results in re-starting of the voltage generating circuit 132. Moreover, the display drive device 100A itself may be re-started by the determination circuit 170.

As a result, in the display drive device 100A, it is possible to deal with an abnormal display of the LCD 150 when an operation register of the voltage generating circuit 132 is cleared due to an external factor, such as ESD, without a complicated setup operation.

Various Embodiments to which the Present Invention may be Applied

Furthermore, the display drive devices in the first to fourth embodiments as described above are simply provided as examples. The present invention is not limited to the above embodiments, and a number of alternatives, modifications, or alterations to the invention as described herein may be made within the spirit and scope of the present invention.

For example, the above display drive device 100 of FIG. 2 describes a case that a register storing an electronic volume value of the voltage generating circuit 132 is removed due to an external factor, such as ESD. However, in addition, even in the case where a reset command that originates a reset signal appears due to an external factor, and a register of the display drive device 100 is suddenly reset, it is possible to suppress a period of abnormal display to a minimum.

Further, the above display drive device 100 of FIG. 2 takes an example of a device comprising the display data RAM 122. However, the present invention is not limited to the above example but can be applied to a display drive device not comprising the display data RAM 122. In this case, the display data D received from the I/O buffer circuit 100 shown in FIG. 2 is directly supplied to the LCD drive circuit 124 through the control circuit 112.

Even in case of being used as such a display drive device, it is possible to frequently renew initial setup information and suppress the period that the register as already set is suddenly cleared due to an external factor such as ESD, to a minimum.

Further, the above display drive circuit 100 of FIGS. 1 and 2 describes the construction that the voltage generating circuit 132 and EEPROM 142 are provided, in particular, outside the drive control device 102, that is, a drive control unit related to display drive (i.e., in case of not being formed as one IC), which is just an example. At least one of the voltage generating circuit 132 and EEPROM 142 may be included in the drive control device 102 as one IC.

Electro-Optical Device and Electronic Apparatus

As shown in the liquid crystal device 10 of FIG. 1, a liquid crystal device integrally comprising a display drive device of the above embodiments and various applications thereof and the LCD 150 as a display unit can be employed.

Figure 8:
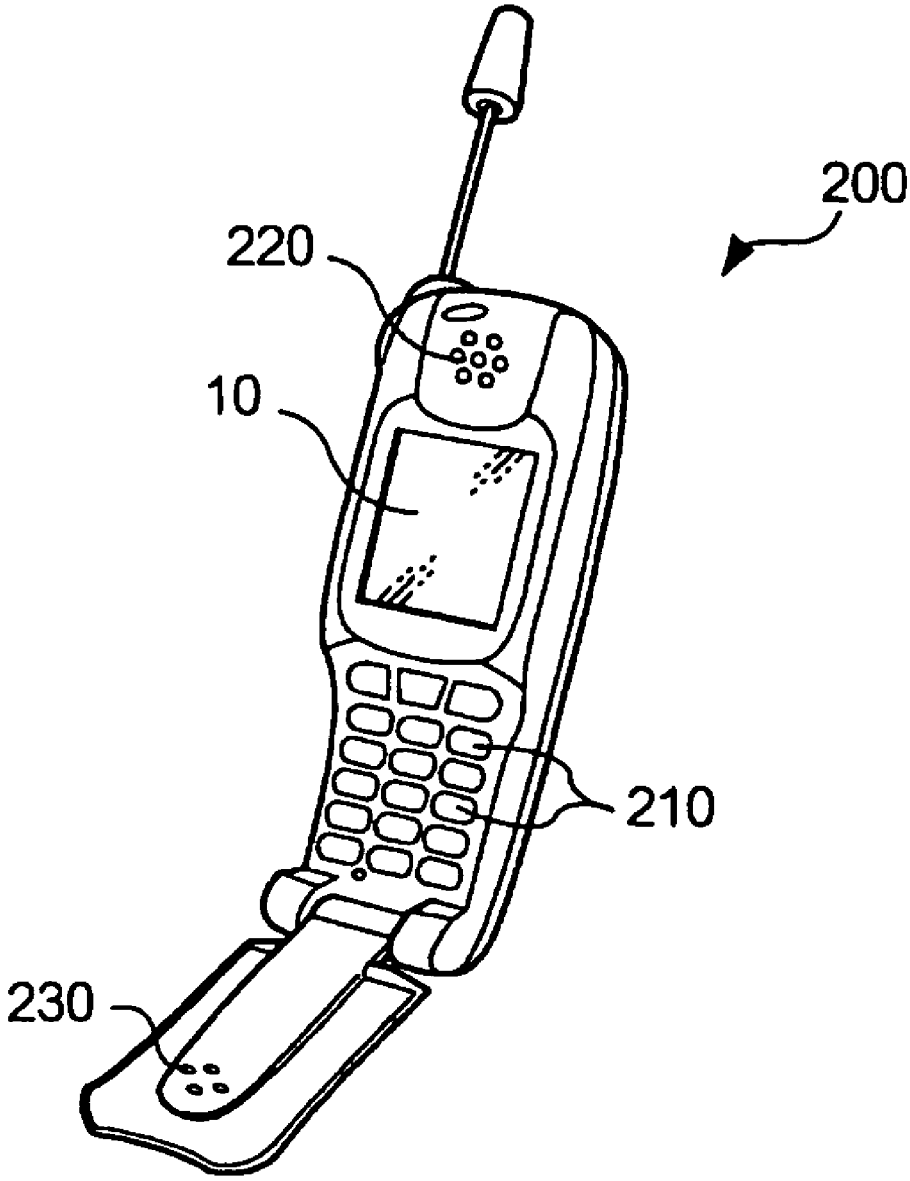
FIG. 8 illustrates an example of an electronic apparatus comprising the liquid crystal device of FIG. 1.

FIG. 8 is an external view of a portable telephone 200 equipped with the above liquid crystal device 10. In FIG. 8, the portable telephone 200 comprises an earpiece 220, mouthpiece 230, and liquid crystal device 10 as a display unit that displays a variety of information, such as phone numbers, in addition to a plurality of operation buttons 210.

Besides the portable telephone 200, the liquid crystal device 10 comprising the display drive device of the present invention can be applied to various electronic apparatuses, such as computers, projectors, digital cameras, movie cameras, PDAs (Personal Digital Assistants), vehicle-mounted devices, copiers, audio apparatuses, and so on. Further, the display drive device of the present invention can be applied to electro-optical devices, such as electroluminescent (EL) devices, plasma displays, electrophoresis devices (EPD), electron-emitter devices (EED) and so on, in addition to the liquid crystal device.

What is claimed is:

1. A display drive device comprising:

a drive circuit driving a display unit in which pixels are formed;

a nonvolatile storage circuit storing screen information indicating a position of a pixel to be driven in the display unit;

a control circuit reading the screen information from the nonvolatile storage circuit;

a drive setup circuit setting a position based on the screen information read by the control circuit in the drive circuit, the drive setup circuit including an address control circuit that controls a driving column of pixels and a reading address for display data; and a determination circuit that determines whether a drive voltage is supplied from a voltage supply circuit that supplies a drive voltage to the drive circuit based on the screen information read by the control circuit, and, if the determination is negative, re-starts the voltage supply circuit and starts a re-setup operation by the drive setup circuit re-setting the position based on the screen information read by the control circuit.

2. The display drive device according to claim 1, wherein the control circuit reads the screen information from the nonvolatile storage circuit in synchronization with a supply of a power voltage from a power circuit which supplies a voltage.

3. The display drive device according to claim 1, wherein the control circuit reads the screen information from the nonvolatile storage circuit at predetermined intervals.

4. The display drive device according to claim 1, wherein the nonvolatile storage circuit stores the display information;

the control circuit reads the display information from the nonvolatile storage circuit; and the drive circuit displays the display information read from the control circuit on the display unit.

5. An electro-optical device comprising the display drive device according to claim 1.

6. An electronic apparatus comprising the electro-optical device according to claim 5.

7. A drive setup method of a display drive device comprising the steps of:

reading screen information from a nonvolatile storage circuit which stores the screen information indicating a position of a pixel to be driven, in a display unit in which pixels are formed;

setting a position based on the read screen information;

driving the position set in the display unit;

controlling a driving column of pixels and a reading address for display data with an address control circuit;

driving the display unit by a drive voltage based on the read screen information;

determining whether the drive voltage is supplied from a voltage supply circuit;

re-starting the voltage supply circuit when the determination is negative; and performing a re-setup operation by re-setting the position based on the read screen information when the determination is negative.

8. A display drive device comprising:

a drive circuit driving a display unit in which pixels are formed;

a nonvolatile storage circuit storing setup information to change a drive voltage to be supplied to the drive circuit;

a control circuit reading the setup information from the nonvolatile storage circuit at predetermined intervals;

a voltage supply circuit supplying a drive voltage based on the setup information read by the control circuit to the drive circuit; and a determination circuit that determines whether a drive voltage is supplied from the voltage supply circuit, and, if the determination is negative, re-starts the voltage supply circuit and starts a re-setup operation based on the setup information screen information read by the control circuit.

9. The display drive device according to claim 8, wherein the control circuit receives instruction information for instructing the reading of the setup information and reads the corresponding setup information.

10. An electro optical device comprising the display drive device according to claim 8.

11. The electro-optical device comprising an electronic apparatus according to claim 10.

12. A drive setup method of the display drive device comprising the steps of:

reading setup information from a nonvolatile storage circuit which stores the setup information to change and sets a drive voltage for driving a display unit in which pixels are formed at predetermined intervals;

driving the display unit by a drive voltage based on the read setup information;

determining whether the drive voltage is supplied from a voltage supply circuit;

re-starting the voltage supply circuit when the determination is negative; and performing a re-setup operation based on the read setup information when the determination is negative.

* * * * *